US006305966B1

(12) United States Patent
Arbogast et al.

(10) Patent No.: US 6,305,966 B1
(45) Date of Patent: Oct. 23, 2001

(54) CIRCUIT BOARD RETAINER

(75) Inventors: Porter Rodgers Arbogast; Arlen L Roesner; Tom J Searby; Ronald P Dean, all of Ft. Collins, CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/699,840

(22) Filed: Oct. 30, 2000

(51) Int. Cl.[7] ..... H01R 13/64
(52) U.S. Cl. ..... 439/377
(58) Field of Search ..... 439/328, 327, 439/377, 64

(56) References Cited

U.S. PATENT DOCUMENTS

| | | | | |
|---|---|---|---|---|
| 3,932,016 | * | 1/1976 | Ammenheuser | 439/328 |
| 3,970,198 | | 7/1976 | Prater | 211/41 |
| 4,829,402 | | 5/1989 | Gewebler et al. | 361/383 |
| 4,869,680 | | 9/1989 | Yamamoto et al. | 439/327 |
| 5,036,428 | | 7/1991 | Brownhill et al. | 361/386 |
| 5,200,882 | | 4/1993 | Blomquist | 361/386 |
| 5,234,354 | | 8/1993 | Smart | 439/326 |
| 5,290,122 | | 3/1994 | Hulme | 403/374 |
| 5,303,123 | | 4/1994 | Chandler et al. | 361/785 |
| 5,383,793 | | 1/1995 | Hsu et al. | 439/327 |
| 5,389,001 | * | 2/1995 | Broschard, III et al. | 439/159 |
| 5,404,274 | | 4/1995 | Bond et al. | 361/759 |
| 5,407,297 | | 4/1995 | Hulme et al. | 403/409 |
| 5,580,203 | | 12/1996 | Read et al. | 411/508 |
| 5,607,273 | | 3/1997 | Kecmer et al. | 411/79 |
| 5,726,859 | | 3/1998 | Khadem et al. | 361/760 |
| 5,779,388 | | 7/1998 | Yamamoto | 403/405 |
| 5,781,417 | | 7/1998 | Albani et al. | 361/801 |
| 6,168,450 | * | 1/2001 | Davis et al. | 439/327 |

* cited by examiner

*Primary Examiner*—Brian Sircus
*Assistant Examiner*—Phuong KT Dinh
(74) *Attorney, Agent, or Firm*—Kevin M. Hart

(57) ABSTRACT

Two opposing connector catches are disposed on resilient stems at the bottom of a circuit board retainer. A frame is disposed between the catches. The frame fits around the profile of a connector. The catches slip over the ends of the connector and engage shoulders on the ends of the connector. Opposing upright members are coupled to the frame and the catches. A circuit board is lowered between the upright members. Two opposing board catches on the upright members engage corresponding notches formed in the circuit board. To disassemble the circuit board from the retainer, the upright members are bent away from one another to disengage the board catches from the notches. To disassemble the retainer from the connector, the upright members are bent toward one another to disengage the connector catches from the shoulders.

18 Claims, 5 Drawing Sheets

CIRCUIT BOARD RETAINER

Field of the Invention

This invention relates to techniques for retaining printed circuit boards in connectors.

BACKGROUND

Many printed circuit boards are designed to engage a longitudinal connector along all or part of one of the edges of the circuit board. For example, in the field of computer equipment, it is common to mount a longitudinal connector on the face of a main board (the "motherboard"), and to engage the edge of a secondary board (a "daughterboard") with the connector on the motherboard. Typically, daughterboards are oriented at right angles with the plane of the motherboard.

It sometimes happens that the connection between a daughterboard and motherboard is compromised because of vibration or shock. For example, vibration and shock usually occur during the transport of a computer. Occasionally, the vibration and shock occurring during transport will cause a daughterboard to be shaken loose from its connector.

Although numerous circuit board retention techniques have been devised to address the shock and vibration problem, the prior art techniques have drawbacks associated with them: Primarily, they require the addition of complicated hardware (such as levers, hinges, screws or metal pins) either to the connector or to the board, or both. The addition of this kind of hardware adds undesirable cost and weight to the final assembly.

It is an object of the invention to provide an improved technique for retaining the edge of a circuit board inside a longitudinal connector.

It is an additional object of the invention to do so in a manner that eliminates the need for expensive and heavy additional hardware.

SUMMARY OF THE INVENTION

A circuit board retainer according to the invention may be constructed from a unitary piece of light weight flexible plastic. Two opposing connector catches are disposed at the bottom of the retainer on resilient stems. A frame is disposed between the catches. The frame fits around the profile of a longitudinal connector while the catches slip over the ends of the connector. The retainer becomes captive to the connector when the catches engage shoulders on the ends of the connector. Resilient opposing upright members are coupled to the frame and the catches. The upright members may be separated from each other by a distance approximately equal to an edge length of the circuit board to be retained. To assemble the circuit board into the retainer and the connector, the circuit board is lowered between the upright members toward the connector. As the circuit board engages the connector, two opposing board catches on the upright members engage corresponding notches formed in the circuit board. Alternatively, the notches may be formed in the upright members, and the catches formed on the circuit board. To disassemble the circuit board from the retainer, the upright members are bent away from one another to disengage the board catches while the circuit board is removed from the connector. To disassemble the retainer from the connector, the upright members are bent toward one another to disengage the connector catches from the shoulders while the retainer is removed from the connector.

DETAILED DESCRIPTION OF THE PREFERRED EMBODIMENTS

Figure 1:
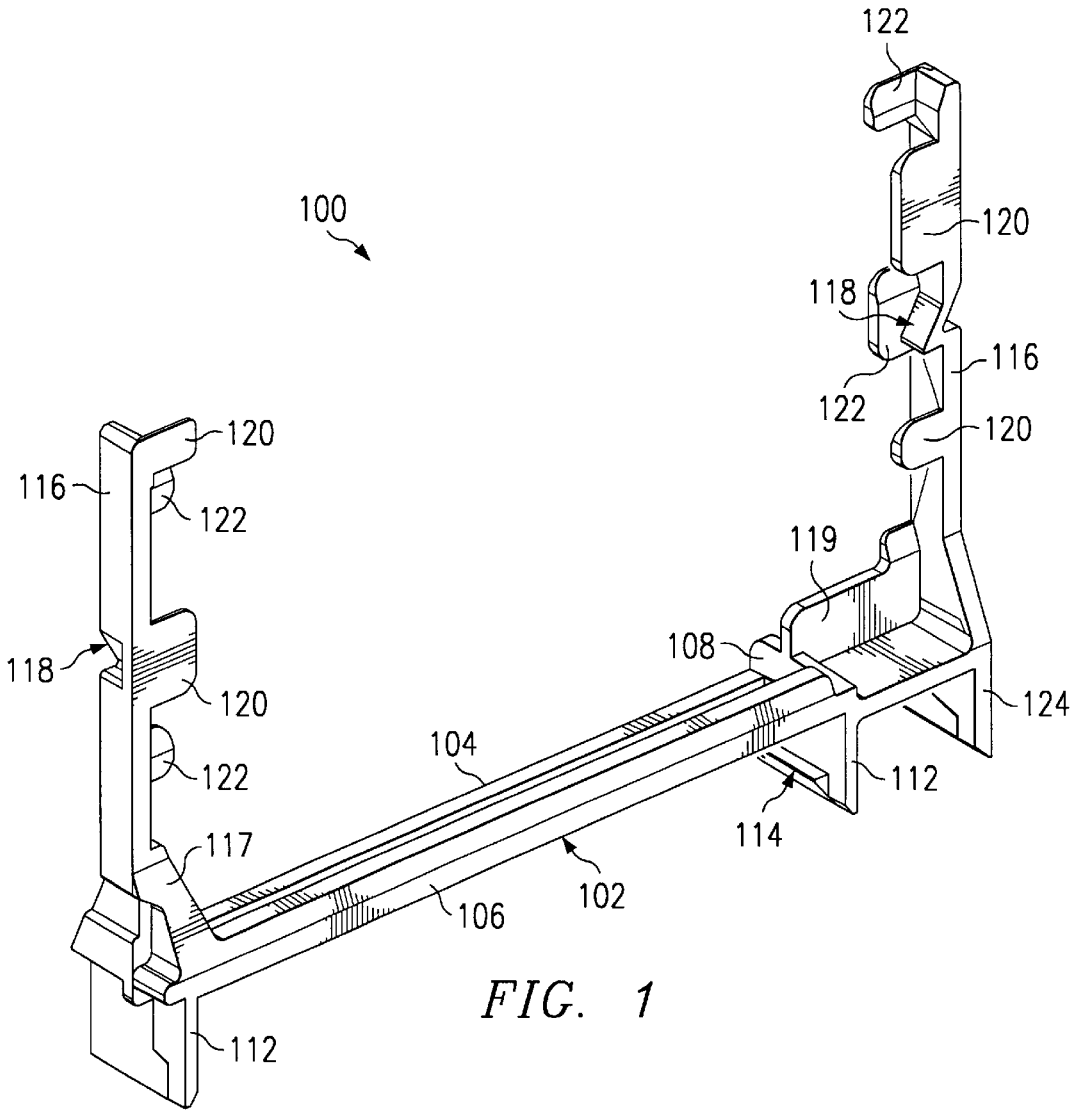
FIG. 1 is an oblique view of a circuit board retainer according to a preferred embodiment of the invention.
Figure 3:
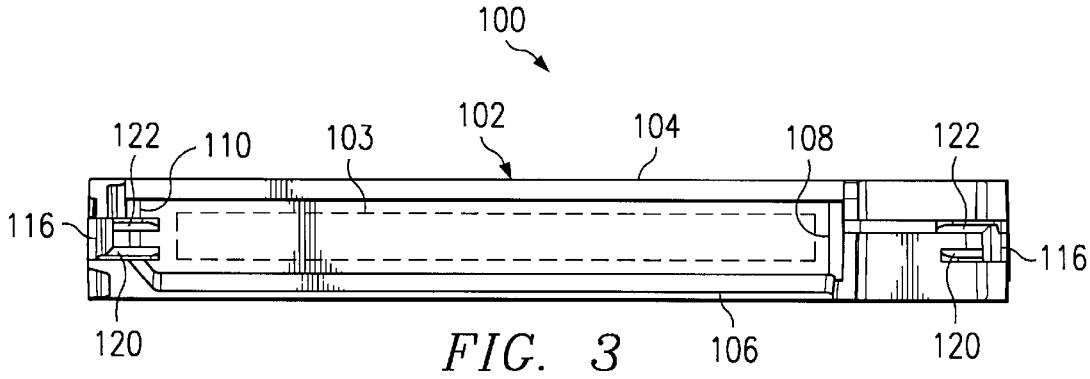
FIG. 3 is a top orthogonal view of the circuit board retainer of FIG. 1.
Figure 2:
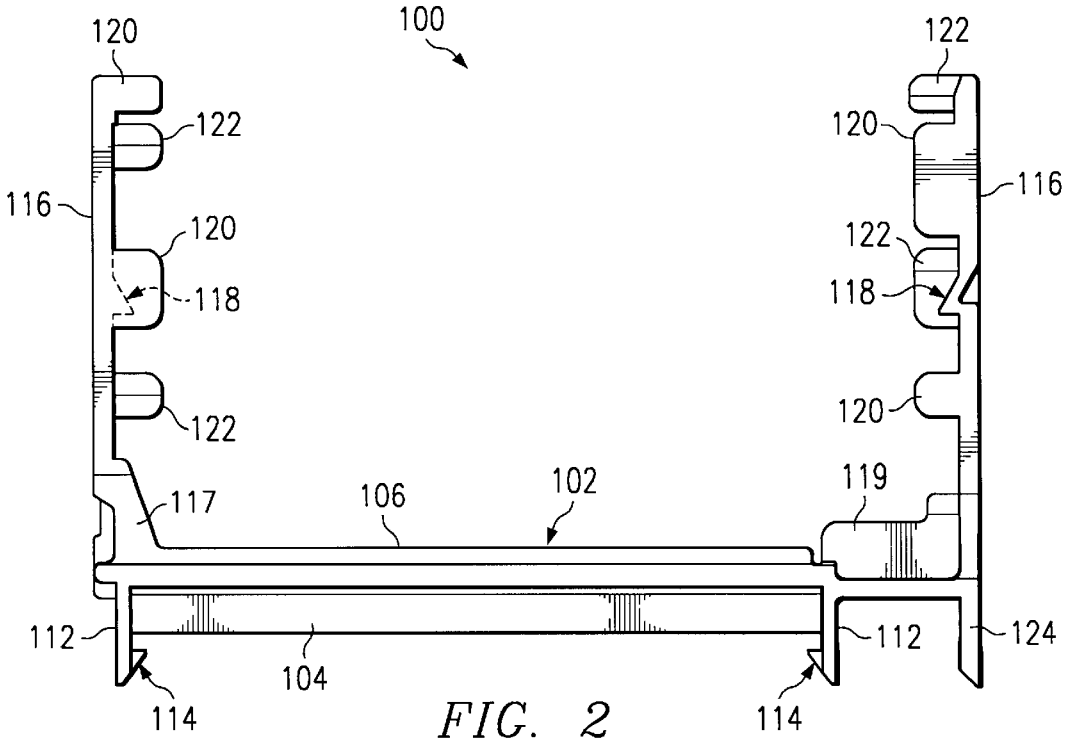
FIG. 2 is a front orthogonal view of the circuit board retainer of FIG. 1.
Figure 4:
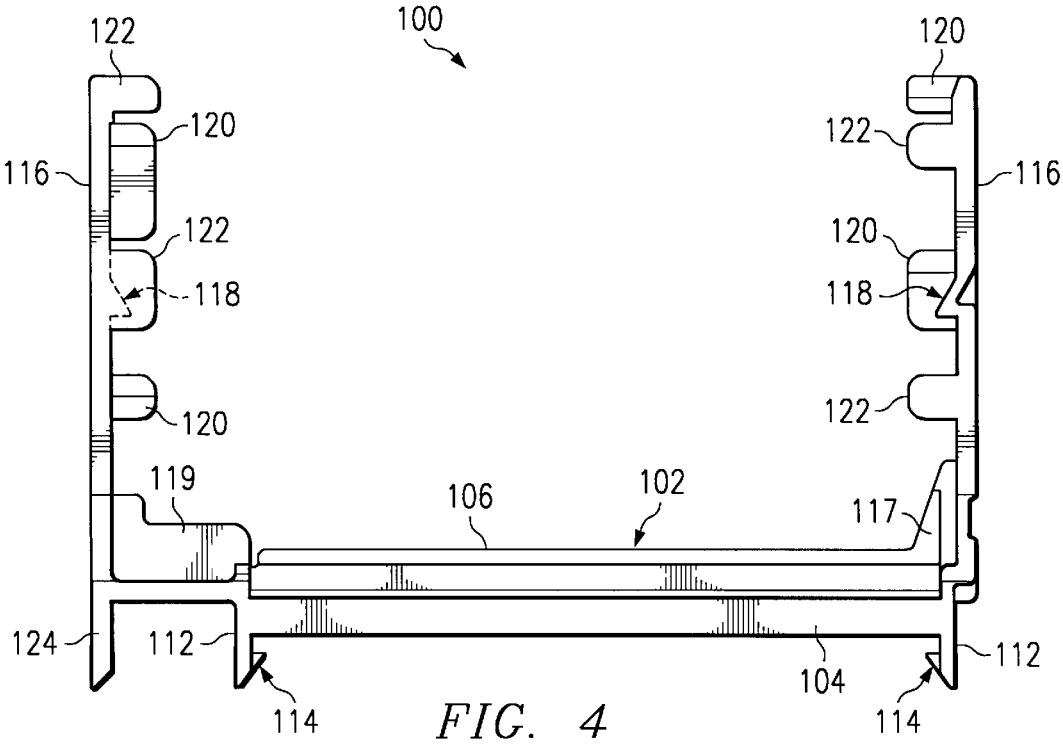
FIG. 4 is a back orthogonal view of the circuit board retainer of FIG. 1.
Figure 5:
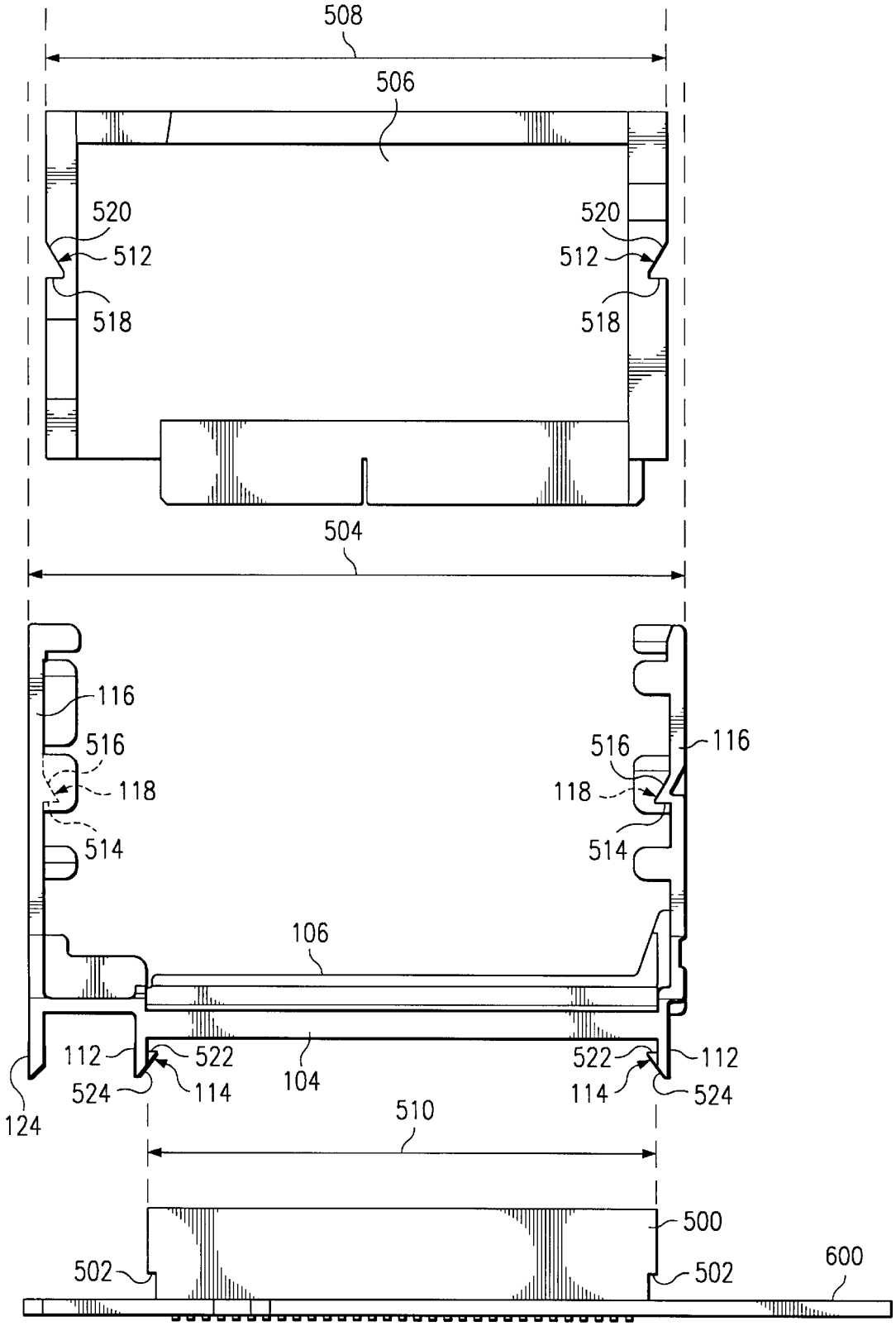
FIG. 5 is an exploded side view of a preferred assembly of components including the circuit board retainer of FIG. 1.

The structure of a preferred embodiment of the invention will now be described in detail with reference to FIGS. 1–5. A circuit board retainer 100 may be constructed from a unitary piece of light weight flexible plastic. In one embodiment, retainer 100 was injection molded using a "PC-ABS" (polycarbonate with acrylonitrile butadiene styrene) plastic; other suitable materials and construction techniques may also be used. A frame 102 has four sides 104, 106, 108 and 110. Preferably, the dimensions of sides 104, 106, 108, 100 are such that frame 102 will just fit around the profile 103 of a connector 500. Two resilient stems 112 extend downward from opposite ends 108, 110 of frame 102. Opposing connector catches 114 are disposed on the bottoms of resilient stems 112. Resilient upright members 116 are coupled to frame 102 and stems 112 by braces 117, 119. Opposing board catches 118 are disposed on upright members 116.

Opposing board guide surfaces 120, 122 are also disposed on upright members 116. Board guide surfaces 120, 122 act to prevent circuit board 506 from slipping out from between upright members 116 when the circuit board is being inserted into retainer 100 and after it has been engaged with connector 500.

Preferably, upright members 116 should be separated from one another by a distance 504 that is just large enough to clear the edge length 508 of circuit board 506. Depending on the size of circuit board 506, edge length 508 may be substantially longer than the longitudinal dimension 510 of connector 500. If so, one or both of upright members 116 may be translated away from stems 112, and a vertical support member 124 may be placed underneath it.

Board catches 118 are adapted to engage corresponding notches 512 in circuit board 506. (Alternatively, catches 118 may be formed on circuit board 506, and notches 512 may be formed in upright members 116.) In the embodiment shown, catches 118 each have a retaining surface 514 and a side surface 516 extending upward from the retaining surface at an angle less than ninety degrees. This shape allows upright members 116 to bend out of the way responsive to the insertion of board 506; upright members 116 snap back into place when notches 512 align with catches 118. Notches 512 have shapes that correspond with catches 118: Each has a retaining surface 518 and a side surface 520 extending upward from the retaining surface at an angle less than ninety degrees. Preferably, retaining surfaces 514 and 518 should be oriented at right angles to the direction of insertion of circuit board 506 into connector 500.

Connector catches 114 are adapted to engage shoulders 502 on the ends of connector 500. Each catch 114 has a retaining surface 522 and a side surface 524 extending downward from the retaining surface at an angle less than ninety degrees. This shape allows stems 112 to bend out of the way responsive to the force of pressing retainer 100 down over connector 500; stems 112 snap back into place when connector catches 114 align with shoulders 502. Preferably, retaining surfaces 522 and shoulders 502 should be oriented at right angles to the direction of insertion of circuit board 506 into connector 500.

Figure 6:
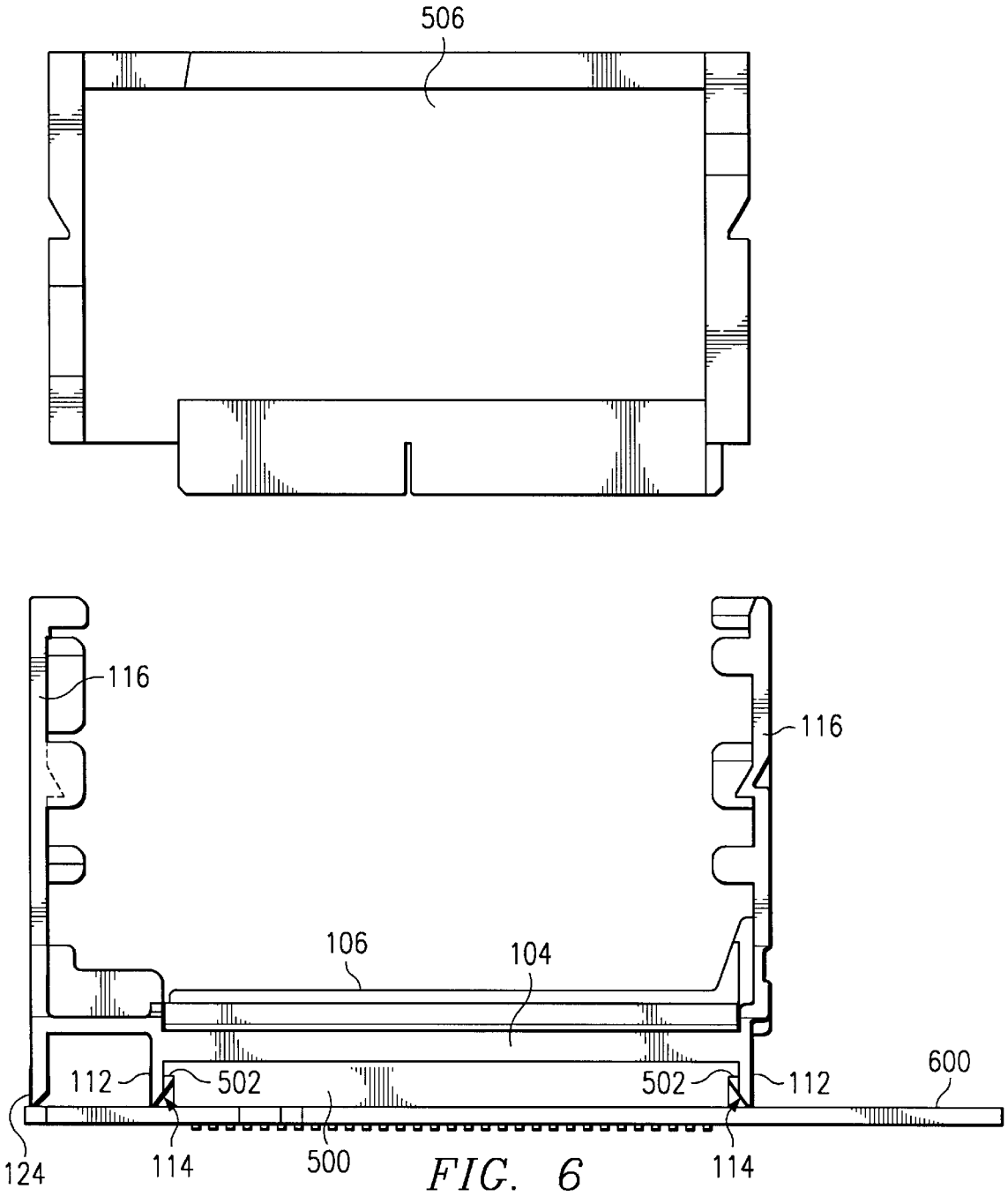
FIG. 6 is a partially assembled side view of the components of FIG. 5.
Figure 7:
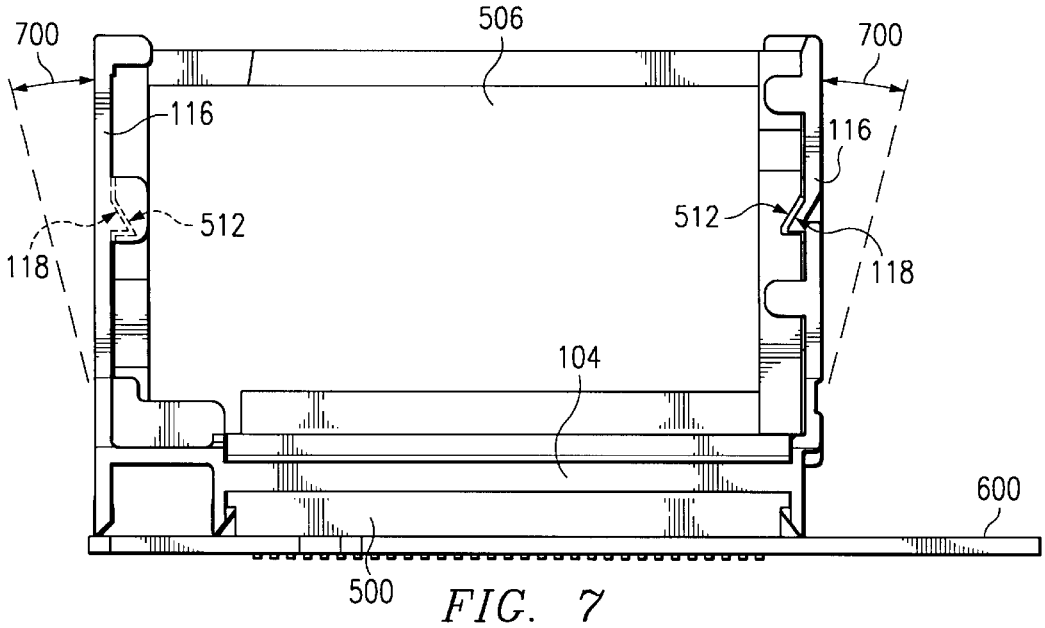
FIG. 7 is a completely assembled side view of the components of FIG. 5.

Preferred assembly and disassembly techniques for retainer 100, circuit board 506 and connector 500 will now be described in detail with reference to FIGS. 6–8. To install retainer 100 onto connector 500, retainer 100 is gently forced down over the top of connector 500 so that frame 102 fits around its profile. Stems 112 will bend back as connector catches 114 slide over the ends of connector 500, and will snap back into place when catches 114 and shoulders 502 align as shown in FIG. 6. This having been done, engagement of frame 102 with the sides of connector 500 prevents translational movement of retainer 100 parallel to the plane of main board 600. Catches 114 and shoulders 502 prevent retainer 100 from moving upward. Stems 112 and vertical support member 124 contact the surface of main board 600 to prevent further downward movement of retainer 100.

To install circuit board 506 into retainer 100, board 506 is aligned between guide surfaces 120, 122 and is gently pressed downward toward connector 500. As board 506 passes by board catches 118, contact between catches 118 and the side edges of board 506 bends upright members 116 backwards as indicated in FIG. 7 at 700. When catches 118 align with notches 512, upright members 116 snap back into place. This having been done, guide surfaces 120, 122 and upright members 116 prevent translational movement of circuit board 506 parallel to the plane of main board 600. Catches 118 and notches 512 prevent board 506 from moving upward. Connector 500 prevents board 506 from moving further downward. To remove board 506 from retainer 100, upright members 116 may simply be bent backwards by hand to disengage catches 118 from notches 512; the board may then be removed from connector 500.

Figure 8:
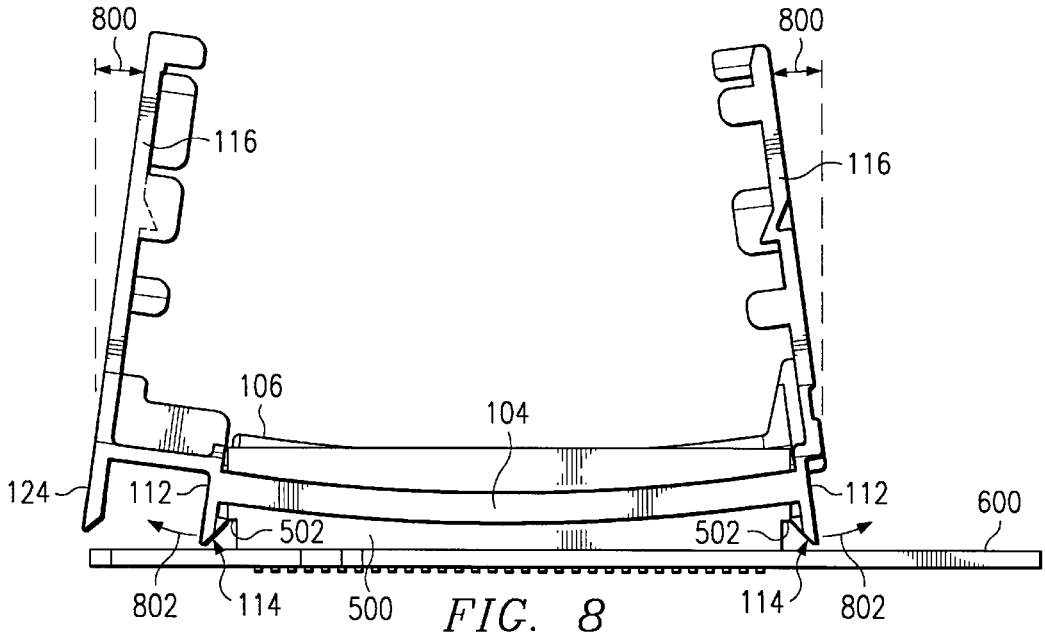
FIG. 8 is a side view illustrating a preliminary step in the removal of the circuit board retainer of FIG. 1 according to a preferred embodiment of the invention.

To remove retainer i00 from connector 500, upright members 116 may be bent inward toward one another by hand as shown in FIG. 8 at 800. Upright members 16 are sufficiently rigid that their inward motion causes stems 112 to pivot away from one another as shown at 802. (Sides 104, 106 of frame should be resilient enough to bend in accommodation of the pivoting action of stems 112.) This pivoting movement of stems 112 away from one another causes connector catches 114 to disengage from shoulders 502, enabling retainer 100 to be pulled upward and off of connector 500.

While the invention has been described herein with reference to a particular embodiment, the illustrated embodiment has been shown by way of example and not by way of limitation. Persons having ordinary skill in the art and having reference to this specification will appreciate that various alternative embodiments may be created while remaining within the scope of the following claims and their equivalents.

What is claimed is:

1. A circuit board retainer, comprising:

a frame adapted to fit around the profile of a connector;

resilient stems extending downward from opposite ends of the frame;

opposing connector catches disposed on the resilient stems, the connector catches adapted to engage shoulders on the ends of the connector;

resilient upright members coupled to the frame and to the resilient stems; and opposing board catches disposed on the upright members, the board catches adapted to engage corresponding notches formed on edges of a circuit board to be retained;

wherein the frame, the resilient stems, the opposing connector catches, the resilient upright members, and the opposing board catches comprise a unitary piece of material.

2. The circuit board retainer of claim 1, wherein:

each of the upright members further comprises opposing circuit board guide surfaces operable to keep the circuit board between the upright members as the circuit board is being inserted.

3. The circuit board retainer of claim 1, wherein:

the upright members are separated by a distance sufficient to just clear an edge length of the circuit board to be retained.

4. The circuit board retainer of claim 3, wherein:

the distance is longer than the longitudinal dimension of the connector; and further comprising a vertical support member at the bottom of one of the upright members.

5. The circuit board retainer of claim 1, wherein:

the unitary piece of material comprises flexible plastic.

6. The circuit board retainer of claim 1, wherein:

the board catches and the corresponding notches each comprise a retaining surface and a side surface extending upward from the retaining surface at a less than ninety degree angle.

7. The circuit board retainer of claim 1, wherein:

the connector catches each comprise a retaining surface and a side surface extending downward from the retaining surface at a less than ninety degree angle.

8. The circuit board retainer of claim 1, wherein:

the upright members are sufficiently resilient to allow bending them apart to disengage the board catches from the notches in order to remove the circuit board.

9. The circuit board retainer of claim 1, wherein:

the upright members are sufficiently rigid such that, when they are bent toward one another, they cause the resilient stems to rotate in opposite directions such that the connector catches move away from one another and disengage from the connector shoulders.

10. The circuit board retainer of claim 8, wherein:

the upright members are sufficiently rigid such that, when they are bent toward one another, they cause the resilient stems to rotate in opposite directions such that the connector catches move away from one another and disengage from the connector shoulders.

11. A circuit board retainer, comprising:

a frame adapted to fit around the profile of a connector;

resilient stems extending downward from opposite ends of the frame;

opposing connector catches disposed on the resilient stems, the connector catches adapted to engage shoulders on the ends of the connector;

resilient upright members coupled to the frame and to the resilient stems; and opposing notches disposed on the upright members, the notches adapted to engage corresponding board catches formed on edges of a circuit board to be retained;

wherein the frame, the resilient stems, the opposing connector catches, the resilient upright members, and the opposing notches comprise a unitary piece of material.

12. The circuit board retainer of claim 11, wherein:

each of the upright members further comprises opposing circuit board guide surfaces operable to keep the circuit board between the upright members as the circuit board is being inserted.

13. The circuit board retainer of claim 11, wherein:

the upright members are separated by a distance sufficient to just clear an edge length of the circuit board to be retained.

14. The circuit board retainer of claim 13, wherein:

the distance is longer than the longitudinal dimension of the connector;

further comprising a vertical support member at the bottom of one of the upright members.

15. The circuit board retainer of claim 11, wherein:

the unitary piece of material comprises flexible plastic.

16. The circuit board retainer of claim 11, wherein:

the upright members are sufficiently resilient to allow bending them apart to disengage the board catches from the notches in order to remove the circuit board.

17. The circuit board retainer of claim 11, wherein:

the upright members are sufficiently rigid such that, when they are bent toward one another, they cause the resilient stems to rotate in opposite directions such that the connector catches move away from one another and disengage from the connector shoulders.

18. The circuit board retainer of claim 16, wherein:

the upright members are sufficiently rigid such that, when they are bent toward one another, they cause the resilient stems to rotate in opposite directions such that the connector catches move away from one another and disengage from the connector shoulders.

* * * * *